US010490956B2

(12) United States Patent
King

(10) Patent No.: US 10,490,956 B2
(45) Date of Patent: Nov. 26, 2019

(54) ELECTRICAL BOX AND BRACKET WITH AN INTERFACE ASSEMBLY

(71) Applicant: Haworth, Inc., Holland, MI (US)

(72) Inventor: Steven Jay King, Holland, MI (US)

(73) Assignee: HAWORTH, INC., Holland, MI (US)

( * ) Notice: Subject to any disclaimer, the term of this patent is extended or adjusted under 35 U.S.C. 154(b) by 0 days.

(21) Appl. No.: 15/616,750

(22) Filed: Jun. 7, 2017

(65) Prior Publication Data

US 2018/0358763 A1 Dec. 13, 2018

(51) Int. Cl.

*H01R 13/73* (2006.01)
*H01R 27/02* (2006.01)
*H01R 25/00* (2006.01)

(52) U.S. Cl.

CPC ..... *H01R 13/73* (2013.01); *H01R 25/006* (2013.01); *H01R 27/02* (2013.01)

(58) Field of Classification Search

CPC ..... H01R 13/73; H01R 13/74; H01R 13/60; H02G 3/288; H02G 3/18
USPC ..... 439/540.1, 211, 215, 216, 535, 536
See application file for complete search history.

(56) References Cited

U.S. PATENT DOCUMENTS 6,183,280 B1 * 2/2001 Laukhuf ..... A47B 21/06 439/214
6,379,182 B1 * 4/2002 Byrne ..... H01R 13/73 439/574
8,758,031 B2 * 6/2014 Cheng ..... H05K 5/02 439/107
8,920,191 B2 * 12/2014 Carpanzano ..... H01R 13/74 439/491
9,246,317 B2 * 1/2016 Byrne ..... H02G 3/105
9,254,035 B2 2/2016 Epstein et al.
2013/0329136 A1 12/2013 McClymonds et al.

OTHER PUBLICATIONS

Haworth Power Technical Sheets dated Dec. 2016, 38 pages.
Workware North America Specification Guide/Price List dated Jun. 2015, 22 pages.
Search Results regarding Conference Table Outlets downloaded Mar. 17, 2017, 6 pages.

* cited by examiner

*Primary Examiner* — Vanessa Girardi
(74) *Attorney, Agent, or Firm* — Haynes Beffel & Wolfeld, LLP

(57) ABSTRACT

An interface module supportable by a support member includes a housing, having an upper portion defining an access opening and a lower portion, and an interface assembly. The interface assembly is mounted to the upper portion at the access opening. The interface assembly includes an interface device, the interface device having an electrical connection element. The lower portion is placeable in a first orientation spaced-apart from the upper portion to provide substantially unhindered access to the electrical connection element, and in a second orientation secured to the upper portion to define an open region between the lower portion and the interface assembly. Examples of the interface device include a utility power interface device, a reduced power electrical interface device, a USB device, an audiovisual interface device, a data interface device, and a communication interface device. The interface module can include rows of interface assemblies overlying the same open region.

12 Claims, 17 Drawing Sheets

ELECTRICAL BOX AND BRACKET WITH AN INTERFACE ASSEMBLY

BACKGROUND OF THE INVENTION

The subject matter discussed in this section should not be assumed to be prior art merely as a result of its mention in this section. Similarly, a problem mentioned in this section or associated with the subject matter provided as background should not be assumed to have been previously recognized in the prior art. The subject matter in this section merely represents different approaches, which in and of themselves may also correspond to implementations of the claimed technology.

Power distribution units with power outlets and a power cord are used in office settings to provide multiple outlets for office equipment. Some units may be constructed by assembling power outlets into an extrusion with lid and end caps to enclose a cavity in which power outlets are connected to the power cord. A disadvantage of this construction method is evident when the power cord and outlet wires are connected via a crimped connection outside of the extrusion and then pushed into the extrusion. This method of assembly can force an assembler to stretch the wires to the outside of the extrusion to access crimp tooling. Once the crimped connections are made the outlets and wiring are then inserted into the extrusion and end caps and lid are assembled to enclose the wiring cavity. The process of inserting the wiring into the extrusion can put undue stress on the wiring connections which may cause a wire to be dislodged from the crimp. This may result in an open circuit or worse only a few strands of wire left connected which can go undetected until put into use and cause a risk of fire or shock.

BRIEF SUMMARY OF THE INVENTION

A simplified summary is provided herein to help enable a basic or general understanding of various aspects of exemplary, non-limiting implementations that follow in the more detailed description and the accompanying drawings. This summary is not intended, however, as an extensive or exhaustive overview. Instead, the sole purpose of this summary is to present some concepts related to some exemplary non-limiting implementations in a simplified form as a prelude to the more detailed description of the various implementations that follow.

An interface module supportable by a support member includes a housing and an interface assembly. The housing includes an upper portion, defining an access opening, and a lower portion. The interface assembly is mounted to the upper portion at the access opening. The interface assembly includes at least one an interface device, the interface device having an electrical connection element. The lower portion is placeable in a first orientation spaced-apart from the upper portion to provide substantially unhindered access to the electrical connection element. The lower portion is also placeable in a second orientation secured to the upper portion to define an open region between the lower portion and the interface assembly.

Examples of the interface module can include one or more the following. The interface device can include a utility power interface device. The interface assembly can include a plurality of interface devices, with each of the interface devices being a utility power interface device in some examples. The interface device can include a reduced power electrical interface device, such as a DC device power interface. The interface assembly can include a USB device.

The interface module can include rows of the interface assemblies overlying the same open region. The interface assembly can include at least one of an audiovisual interface device, a data interface device, and a communication interface device. In some examples the lower portion has a bottom, with the bottom secured to the upper portion when in the second orientation. In some examples the upper portion can include an upper element and spaced-apart sidewalls extending from the upper element, and the lower portion can include a bottom element secured to the side walls when the lower portion is in the second orientation. In some examples the upper portion can include an upper element, a first side wall extending from the upper element, and a bottom element extending from the first side wall, and the lower portion can include a second side wall extending between the upper element and the bottom element of the upper portion.

Other features, aspects and advantages of technology disclosed can be seen on review the drawings, the detailed description, and the claims, which follow.

BRIEF DESCRIPTION OF THE DRAWINGS

The included drawings are for illustrative purposes and serve only to provide examples of possible structures and process operations for one or more implementations of this disclosure. These drawings in no way limit any changes in form and detail that may be made by one skilled in the art without departing from the spirit and scope of this disclosure. A more complete understanding of the subject matter may be derived by referring to the detailed description and claims when considered in conjunction with the following figures, wherein like reference numbers refer to similar elements throughout the figures.

DETAILED DESCRIPTION

Figure 1:
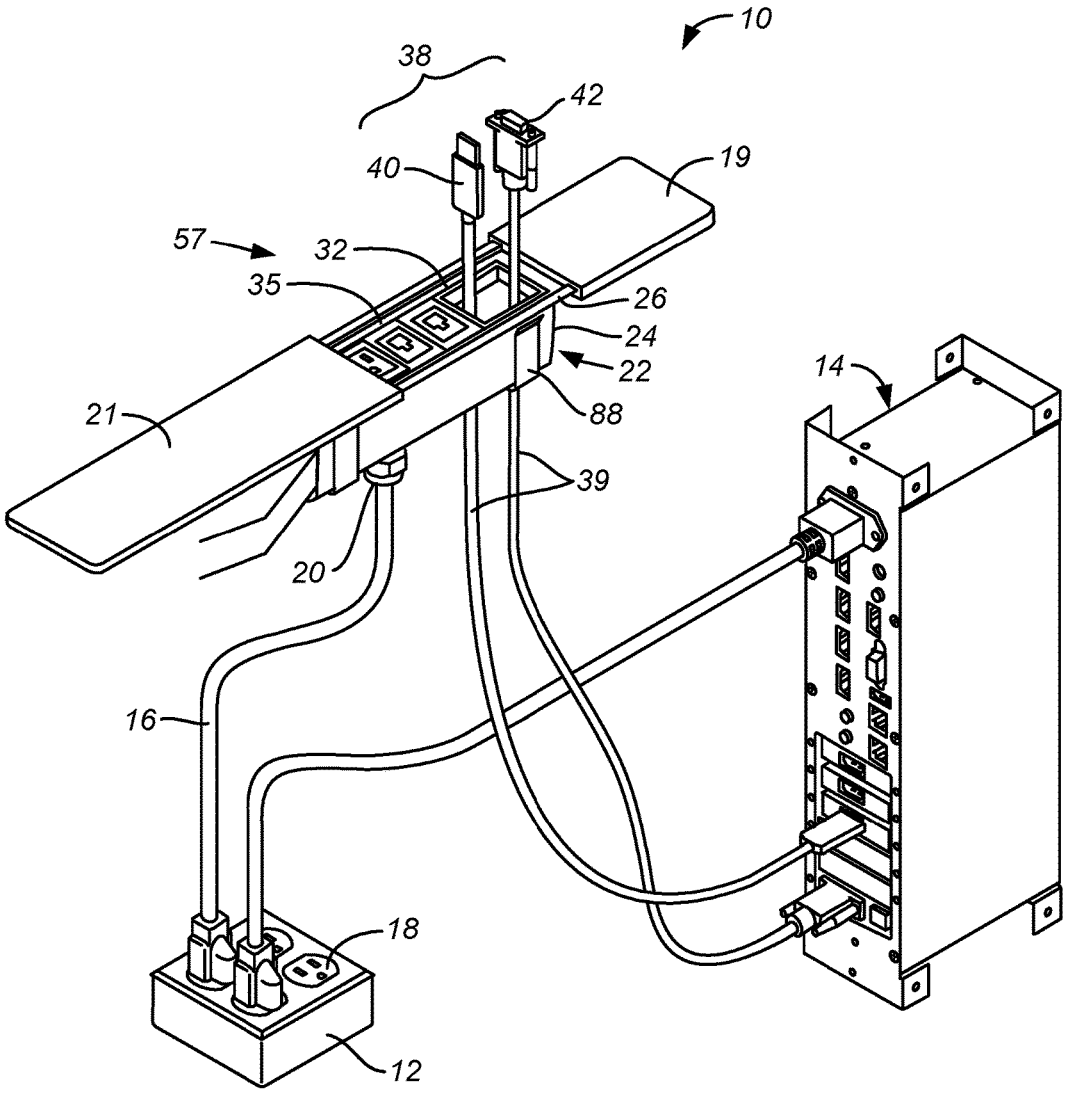
FIG. 1 is an overall, somewhat simplified view of a first example of an interface module with a single row of interface assemblies connected to a utility power source and to a processor.

The following description will typically be with reference to specific structural embodiments and methods. It is to be understood that there is no intention to-be limited to the specifically disclosed embodiments and methods but that other features, elements, methods and embodiments may be used for implementations of this disclosure. Preferred embodiments are described to illustrate the technology disclosed, not to limit its scope, which is defined by the claims. Those of ordinary skill in the art will recognize a variety of equivalent variations on the description that follows. Unless otherwise stated, in this application specified relationships, such as parallel to, aligned with, or in the same plane as, mean that the specified relationships are within limitations of manufacturing processes and within manufacturing variations. When components are described as being coupled, connected, being in contact or contacting one another, they need not be physically directly touching one another unless specifically described as such. Like elements in various embodiments are commonly referred to with like reference numerals.

Referring now to FIGS. 1-4C, FIG. 1 is an overall view of a first example of an interface module 10 connected to a utility power source 12 and to a processor 14. Utility power is provided to interface module 10 through a utility power cord 16 connecting utility power sockets 18 to interface module 10 through a strain relief 20. See FIG. 4C. Interface module 10 includes a housing 22 having a lower portion 24 and an upper portion 26; see FIG. 2. Lower portion 24 has side walls 28 connected by a bottom 30. In the example of FIG. 1, upper portion 26 includes an extension 19, which could be constructed as a touchpad coupled to processor 14. Extension 19 is not illustrated in the remaining figures. Also illustrated in FIG. 1 is a sliding cover 21 used to cover or expose various components of interface module 10.

Figure 4A:
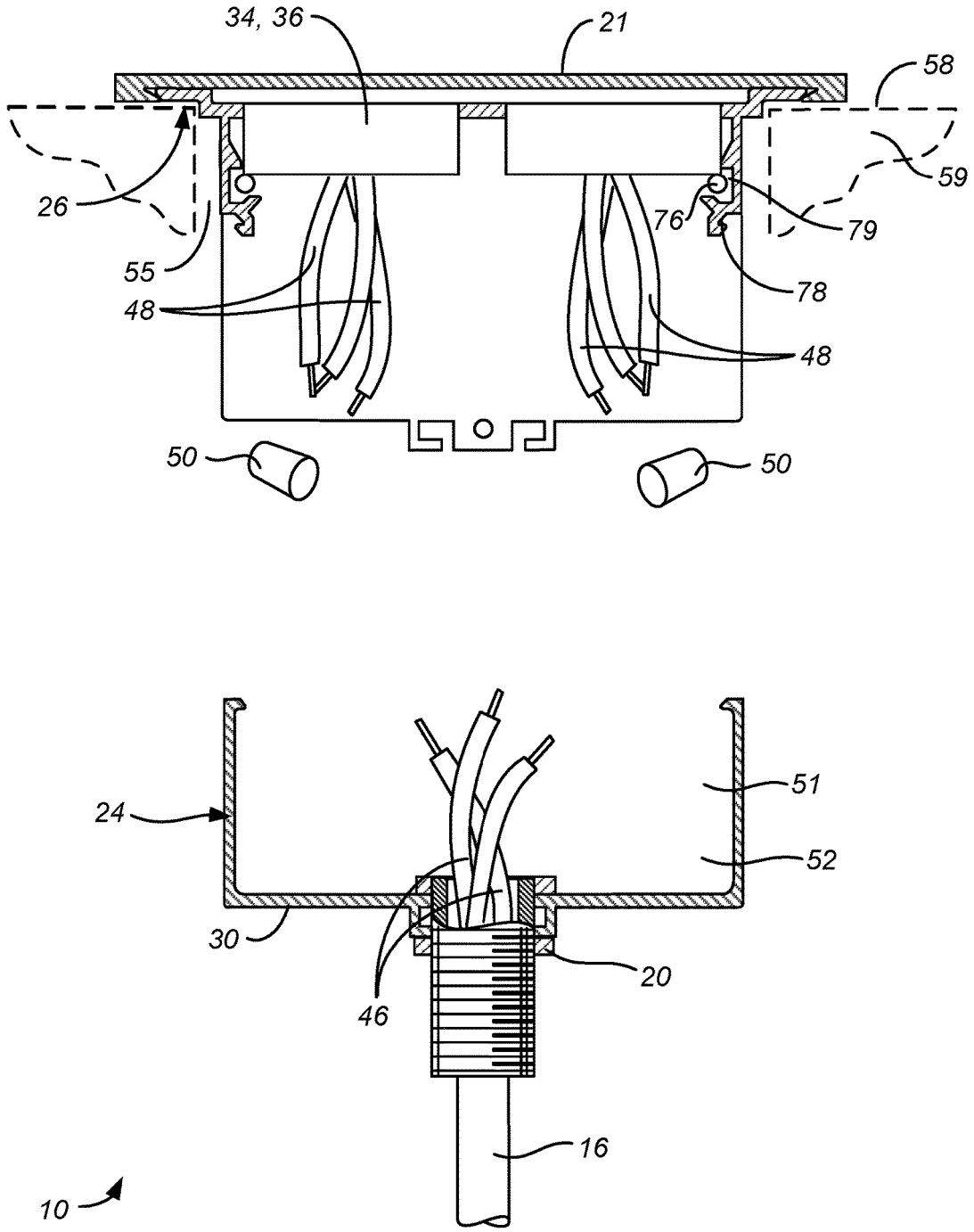
FIG. 4A is a somewhat simplified cross-sectional view taken through a third example of an interface module similar to those of FIGS. 1-3 with an extended width housing and two rows of interface assemblies. The figure shows the interface module prior to the connection of the upper and lower portions of the housing with the lower portion of the housing spaced apart from the upper portion of the housing and the electrical wires not yet connected.
Figure 4B:
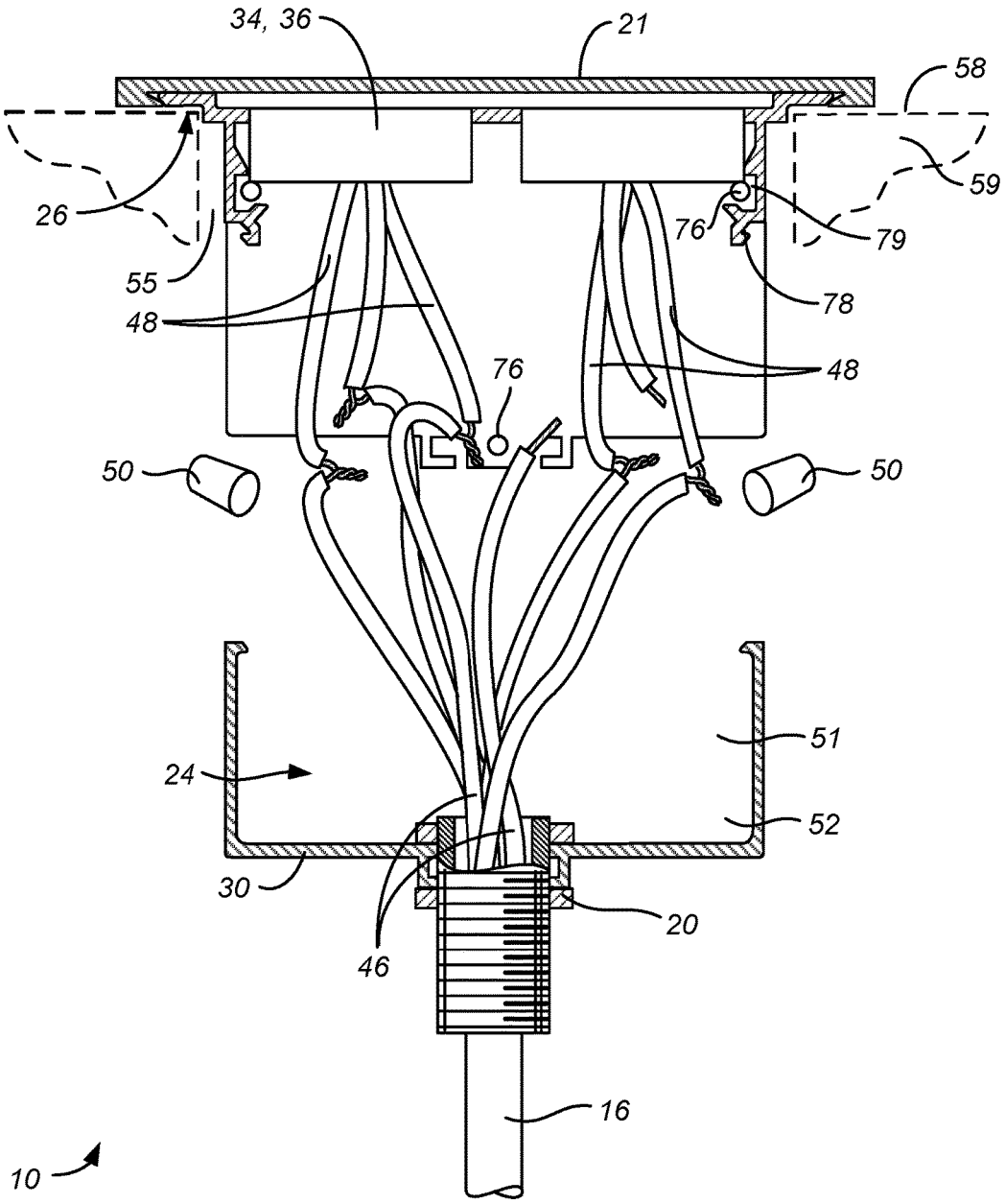
FIG. 4B is a view similar to that of FIG. 4A after some of the electrical wires have been joined to one another but prior to joining the upper and lower portions of the housing.
Figure 4C:
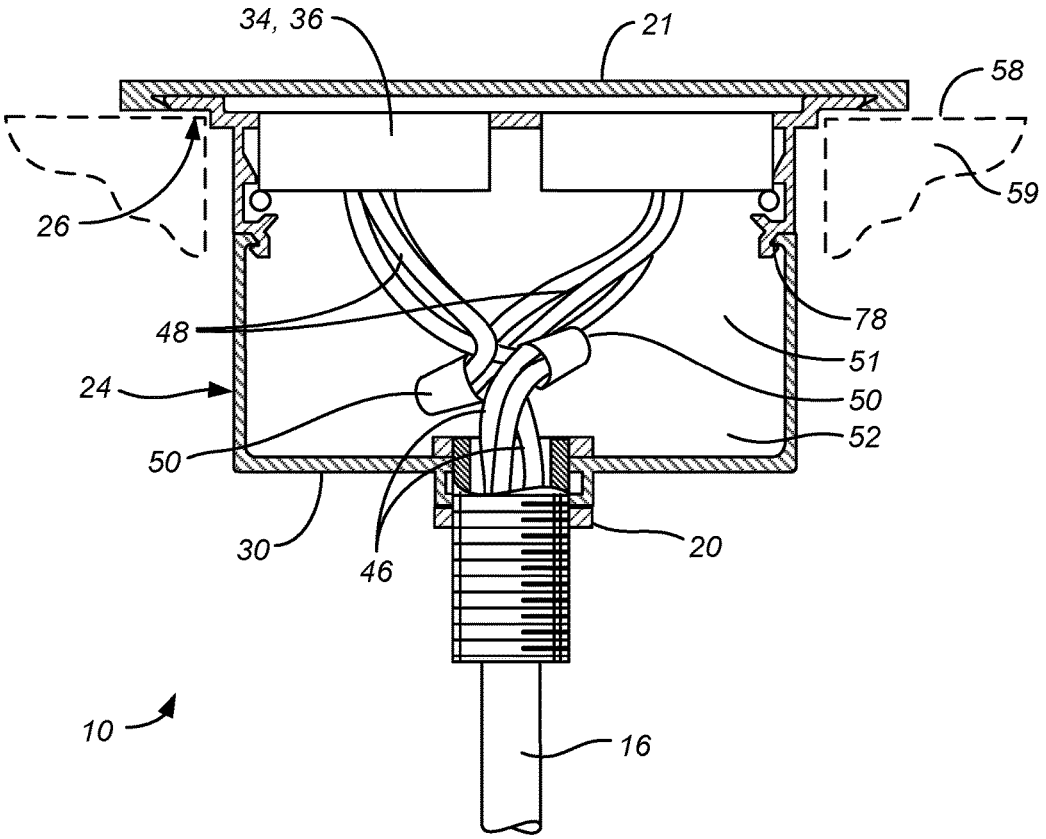
FIG. 4C shows the structure of FIG. 4B after the wires have been connected and thereafter the upper and lower portions of the housing have been joined.
Figure 5:
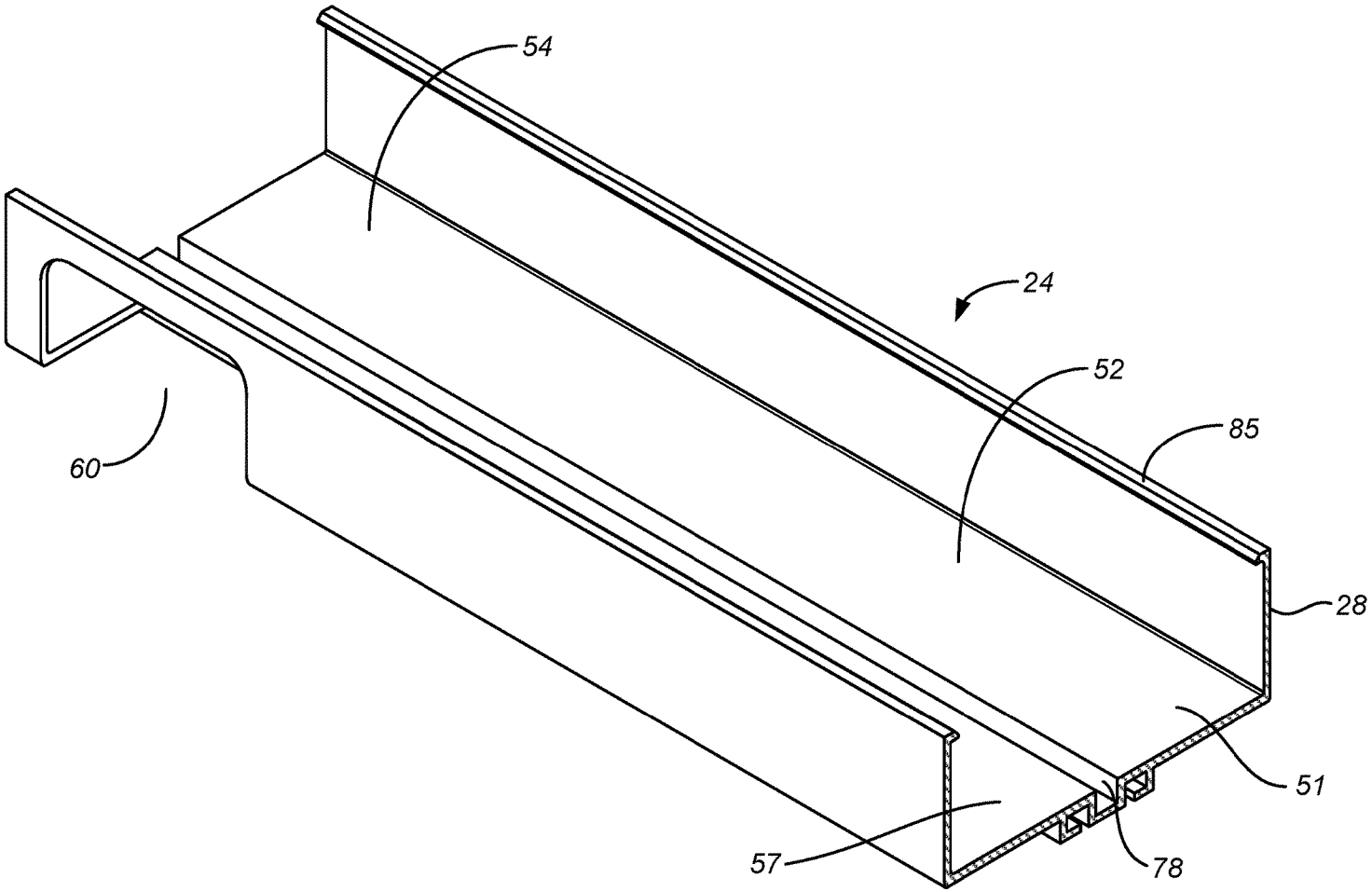
FIG. 5 is an isometric view of the lower portion of the housing of FIG. 4A prior to forming an opening for the passage of electrical wires into the housing.
Figure 6:
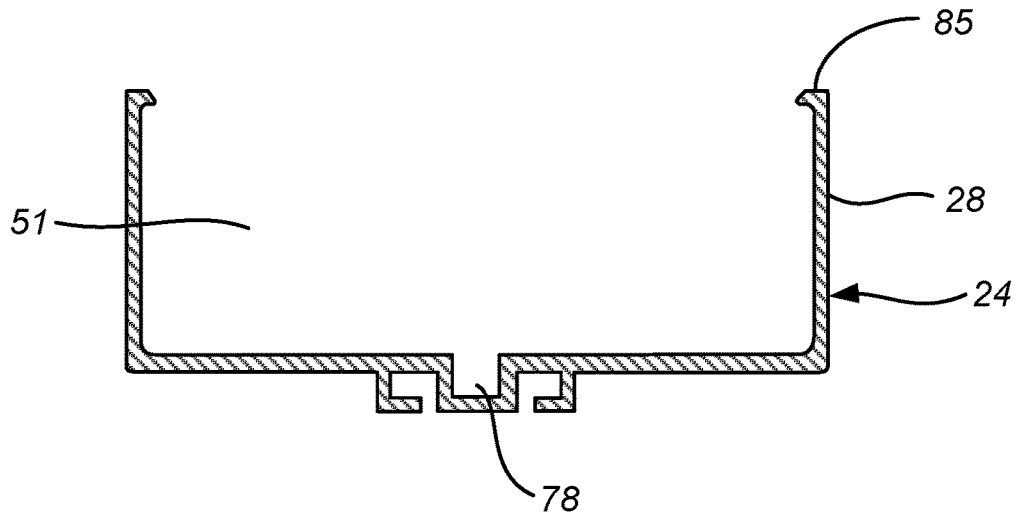
FIG. 6 is a cross-sectional view of the structure of FIG. 5.
Figure 7:
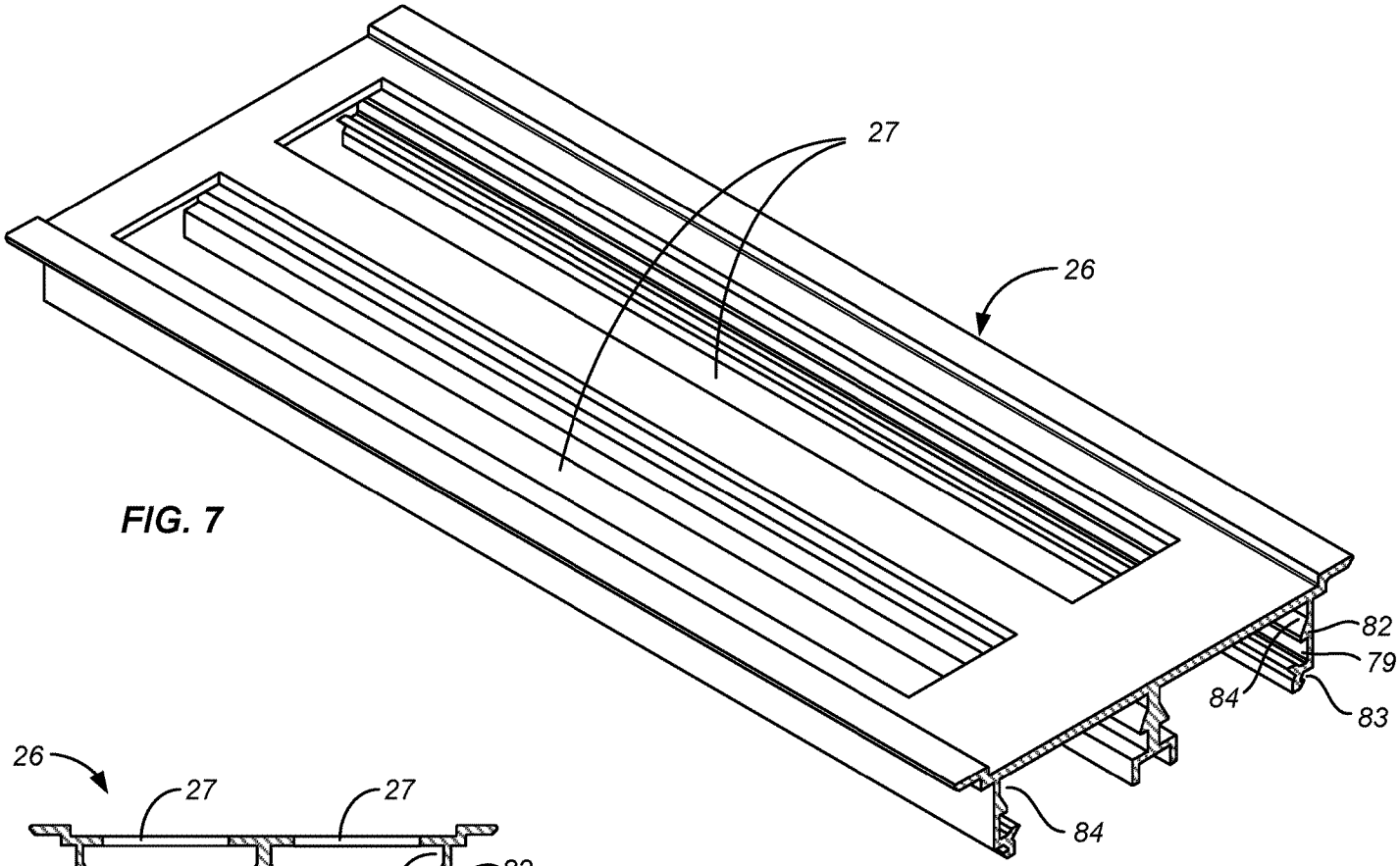
FIG. 7 is an isometric view of the upper portion of the housing of FIG. 4A.
Figure 8:
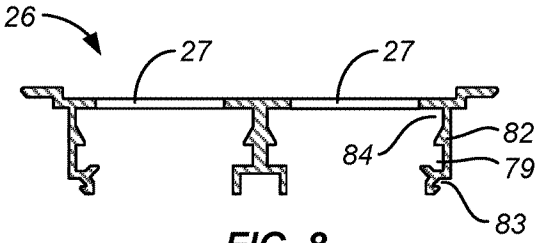
FIG. 8 is a cross-sectional view of the structure of FIG. 7.

FIG. 4C is a somewhat simplified cross-sectional view taken through a third example of an interface module 10. Upper portion 26 of interface module 10 is supported on the upper, support surface 58 of a support member 59 within an opening 55 formed in support member 59. The electrical wires 46 from utility power cord 16 are connected to electrical wires 48 extending from utility power interface devices 36, or in some examples from USB device power interface devices 34, see FIG. 2, by wire nuts 50. Utility power interface devices 36 typically provide full utility power voltage, such as 120 V AC, while USB device power interface devices 34 provide a reduced voltage, such as 5 V DC, and are therefore sometimes referred to as reduced-power electrical interface devices. Wires 48 act as electrical connection elements. Instead of wires 48, wires 46 could be adapted for being electrically joined directly to sockets or other electrical connection elements integral with interface devices 34, 36. As shown in FIGS. 4A and 4B, connection of wires 46 to wires 48 occurs prior to lower portion 24 being secured to upper portion 26 which greatly facilitates making the electrical connections securely without the problems, discussed above in the background, associated with conventional power distribution devices. By minimizing the movement of the components after electrical connections are made, there is less stress on the connections of wires 46, 48 and less chance of an open or partially connected circuit.

Figure 2:
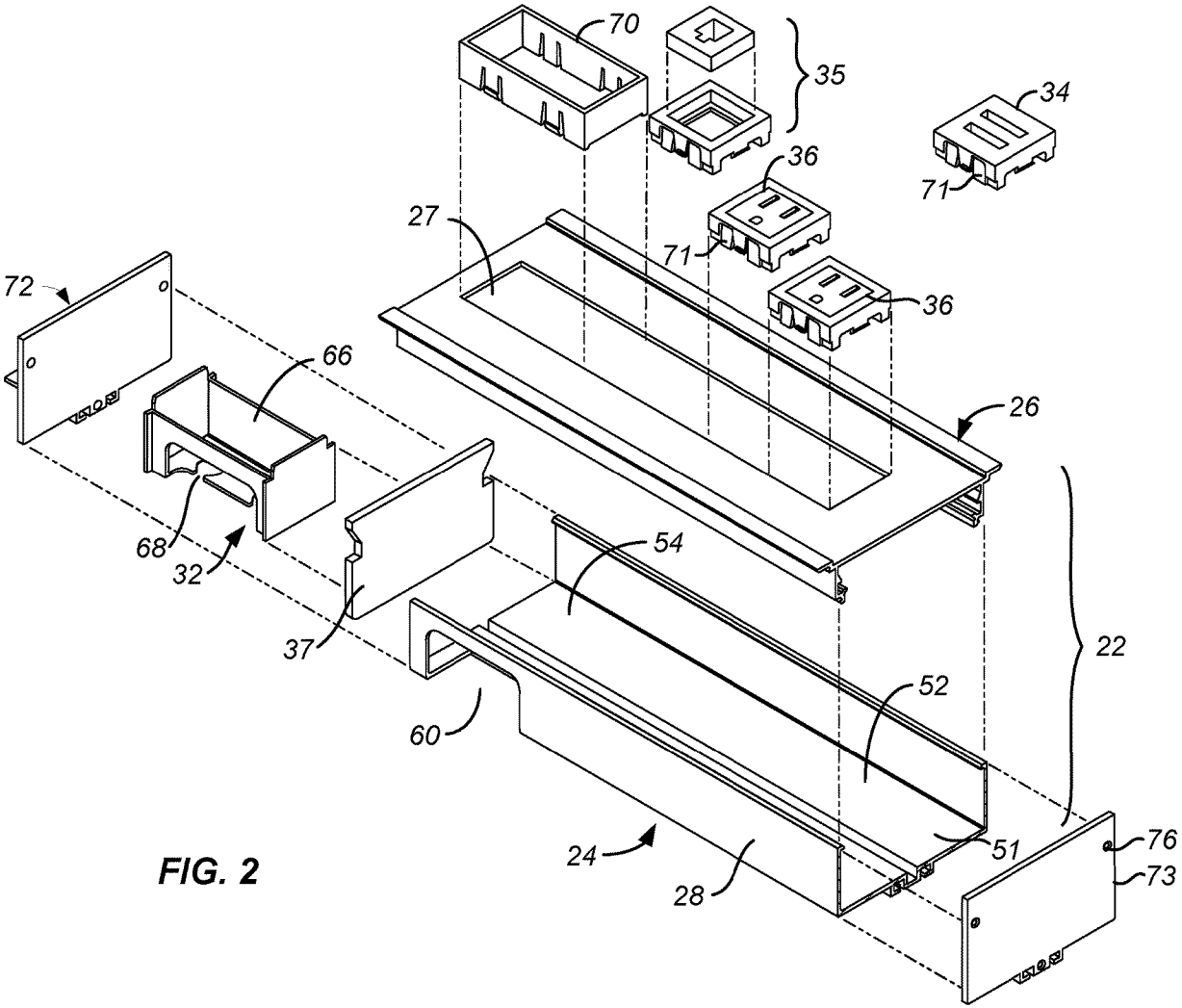
FIG. 2 is an exploded isometric view of a second example of an interface module illustrating components thereof, similar to the interface module of FIG. 1 but with and extended width housing.
Figure 3:
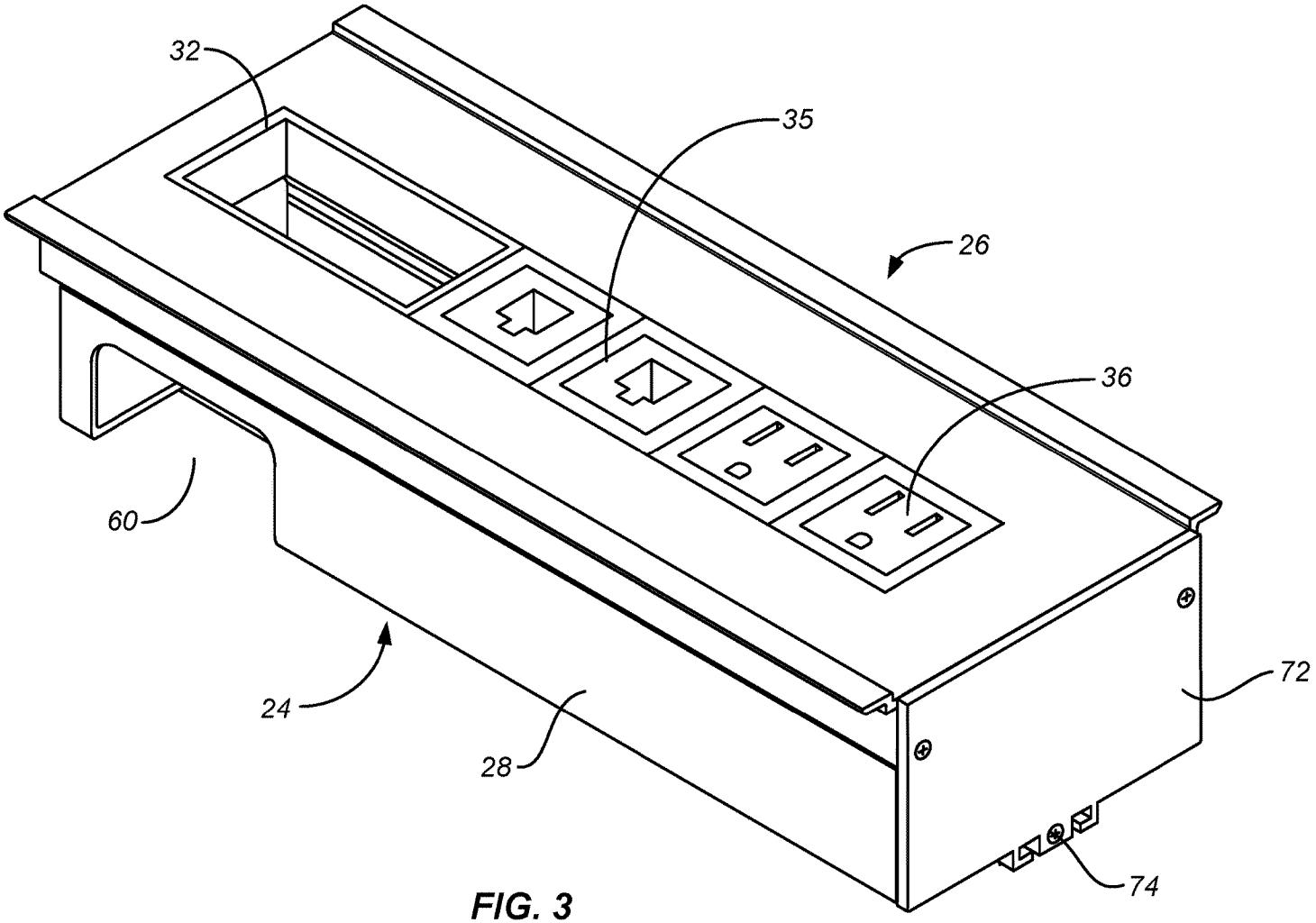
FIG. 3 shows the components of FIG. 2 in an assembled state.

FIG. 2 is an exploded isometric view of a second example of an interface module 10 illustrating components of the interface module. Upper portion 26 of housing 22 acts an access opening 27 extending along most of its length. See also FIGS. 5-8. The second example of interface module 10 shown in FIG. 2 is similar to the first example shown in FIG. 1 except that it has an extended width housing 24. FIG. 3 shows the components of FIG. 2 in an assembled state. Housing interior 51 is divided into a power side 52 containing wires 46, 48 and a non-power side 54 by divider 37. In some examples an end 56 of a cable management device 32 can act as the divider between the power side 52 and a non-power side 54.

Figure 9:
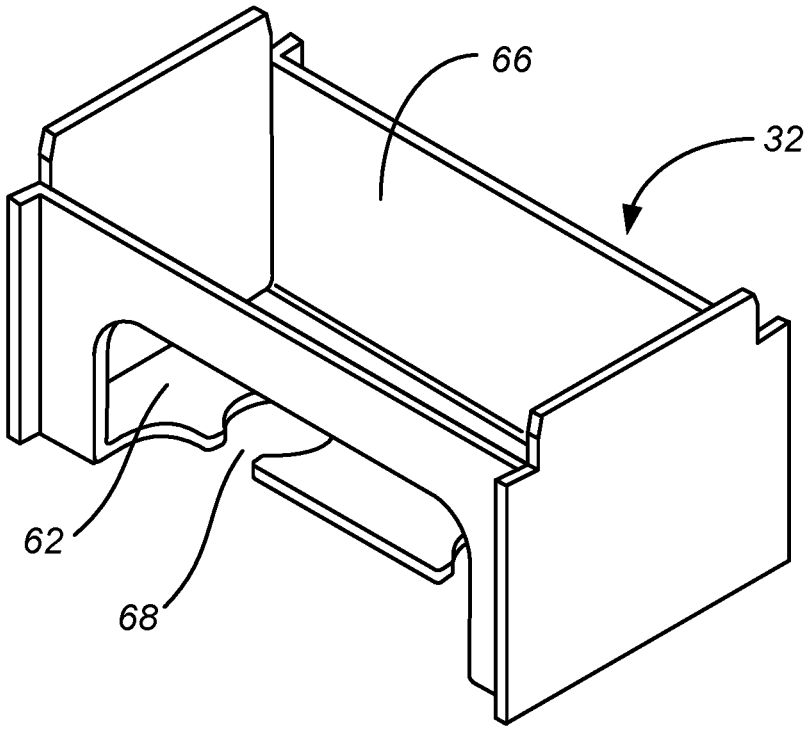
FIG. 9 is an isometric view of the cable management device of FIG. 2.
Figure 10:
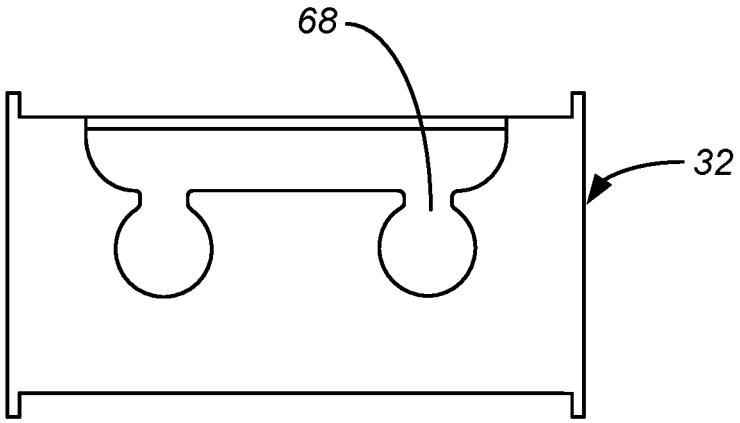
FIG. 10 is a bottom plan view of the cable management device of FIG. 9.
Figure 11:
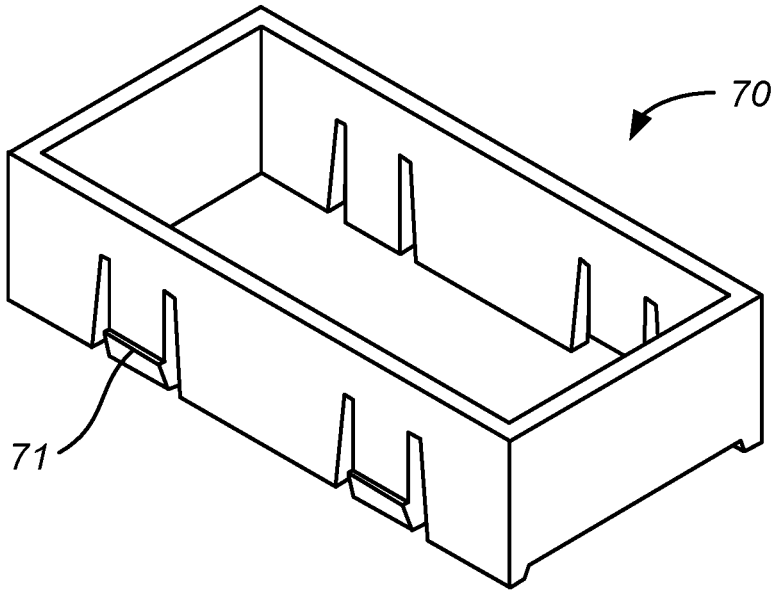
FIG. 11 is an isometric view of the cable management adapter sleeve of FIG. 2.
Figure 12:
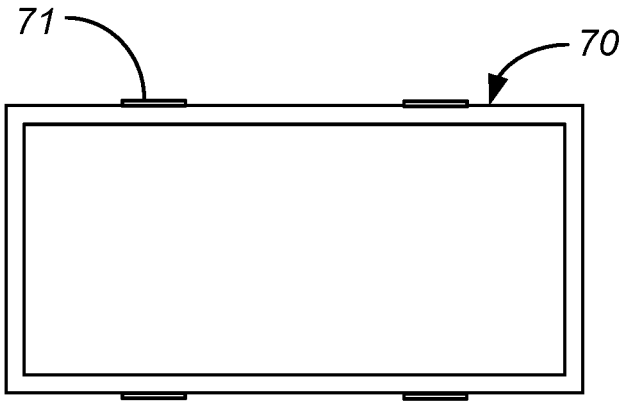
FIG. 12 is a top plan view of the cable management adapter sleeve of FIG. 11.
Figure 13:
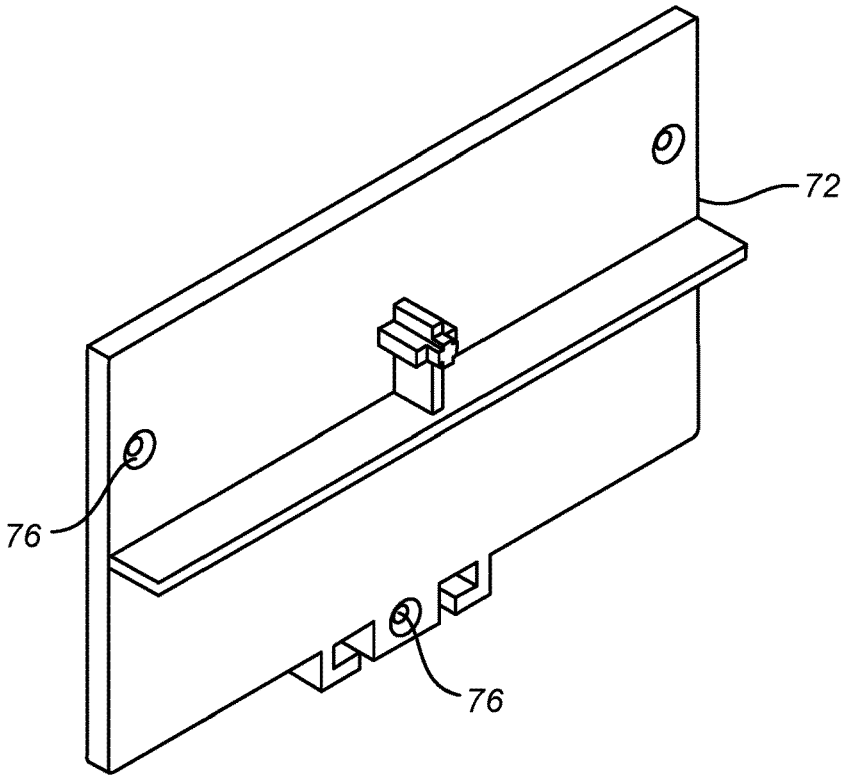
FIG. 13 is an isometric view of a first end cap of the housing illustrating the outside surface of the first end cap.
Figure 13A:
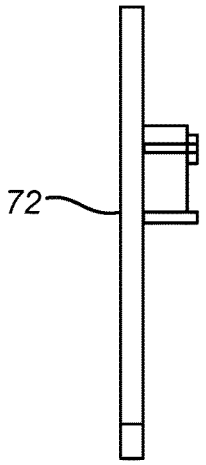
FIG. 13A is a side view of the first end cap of FIG. 13.
Figure 14:
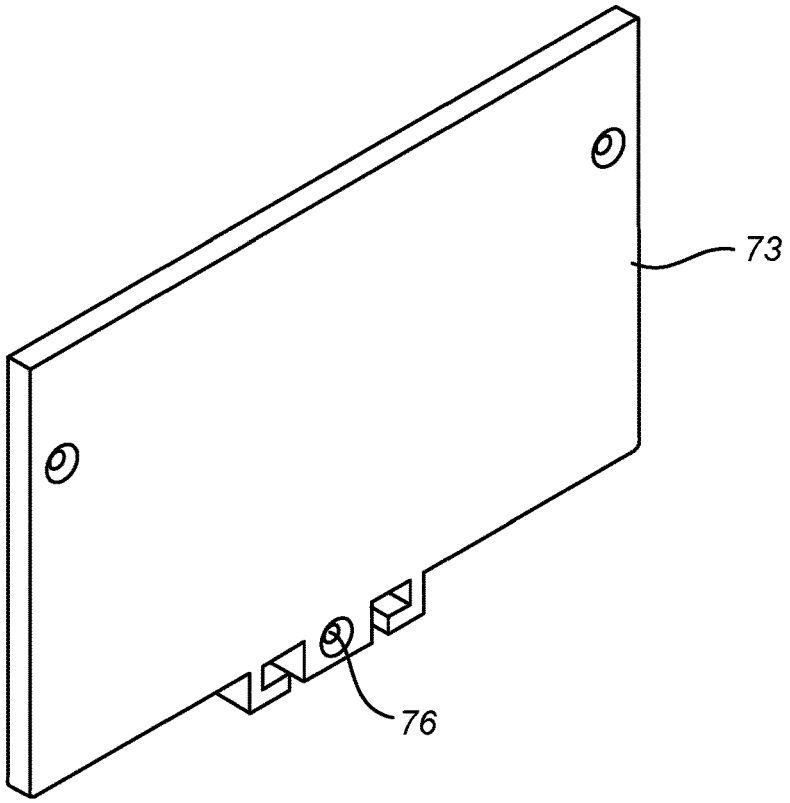
FIG. 14 is an isometric view of a second end cap of the housing illustrating the outside surface of the second end cap.
Figure 14A:
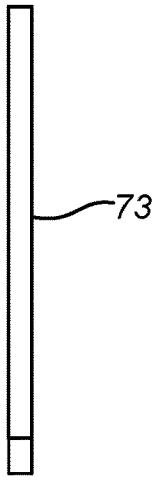
FIG. 14A is a side view of the second end cap of FIG. 14.

FIG. 2 shows a data cable interface 35 to be inserted into non-power side 54 of housing interior 51. FIG. 2 illustrates cable management device 32, also shown in FIGS. 9 and 10, positioned to be slid into the non-power side 54 of housing interior 51 of lower portion 24. Adapter sleeve 70 is also shown positioned for being assembled into non-power side 54 of housing interior 51 to be located above cable management device 32. This example illustrates one cable management device 32 and one adapter sleeve 70, but more than one can also be provided for. USB power interface devices 34 and utility power interface devices 36 are shown spaced apart above power side 52 of housing interior 51. FIG. 1 illustrates other types of interface devices in the form of cable plugs 38 extending from cables 39 connected to processor 14, including, in this example, an USB plug 40 and a video plug 42. USB plug 40 could be coupled to processor 14 to provide power to a user's electronic device, such as a cell phone or a tablet computer.

Access opening 27 of upper portion 26 overlies both power side 52 and non-power side 54. Divider 37 or cable management devices 32 along with adapter sleeves 70, or all three, are typically installed at the factory to provide a sealed environment for the electrical connections for safety and to meet UL requirements. The types of interface devices within power side 52 can be all utility power interface devices 36, all USB device power interface devices 34, or a mixture thereof. Interface devices 34, 36 and adapter sleeves 70 have integral spring clips 71 used to engage grooves 84, see FIG. 8, along edges defining access opening 27 of upper portion 26 to secure the components 34, 36, 72 to the upper portion.

In some cases a data cable interface 35 would be mounted over the non-power side 54, typically for connection to a building data network or to processor 14. The various interface devices including utility power interface device 36, USB device power interface devices 34, data cable interface 35, and cable plugs 38, constitute the interface assembly 57 identified in FIG. 1. Other types of interface devices, such as telephone, videoconferencing connections, audio cables, and control cables, can also be provided.

End panels 72, 73, see FIGS. 13, 13A, 14, 14A, are secured to the ends of lower portion 24 and upper portion 26 with screws 74 passing through holes 76 in the end panels 72, 73 for engagement with screw-thread-engageable openings 78, 79, see FIGS. 5-8, in the lower and upper portions 74, 76.

Upper portion 26 has a pair of rails 82 defining pair of outwardly facing grooves 83. Lower portion 24 has inwardly facing fingers 85 at the upper end of side walls 28 which engage with grooves 83, illustrated here creating a snap latch thereby permitting upper portion 26 to be attached to lower portion 24. The result is shown in FIGS. 3 and 4A-4C.

As mentioned above, interface module 10 is constructed to have utility power cord 16 and all power interface devices 34, 36 mounted to the housing 22. All electrical connections are housed within power side 52 of housing interior 51. Utility power cord 16 could be hardwired to a power source instead of through a plug as shown in FIG. 1.

Figure 17:
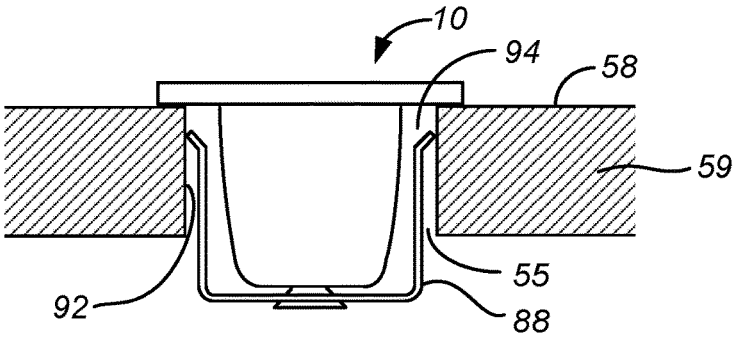
FIGS. 17 and 18 are a simplified cross-sectional and bottom perspective views illustrating the use of a mounting clip, also shown in FIG. 1, secured to the housing and engaging the side walls of an opening in the mounting support member to help stabilize the interface module within the opening.
Figure 18:
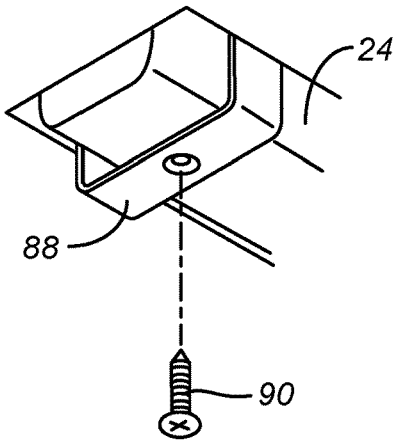

Interface module 10 can be placed on and supported by a support surface 58. FIGS. 17 and 18, which are simplified cross-sectional and bottom perspective views, illustrate the use of housing/support member securement structure in the form of a mounting clip 88, also shown in FIG. 1. Mounting clip 88 is secured to lower housing portion 24 by a screw 90 and engages the side walls 92 which define an open region 94 in the support member 59. Using mounting clips 88 helps to stabilize the interface module 10 within open region 94.

Figure 15:
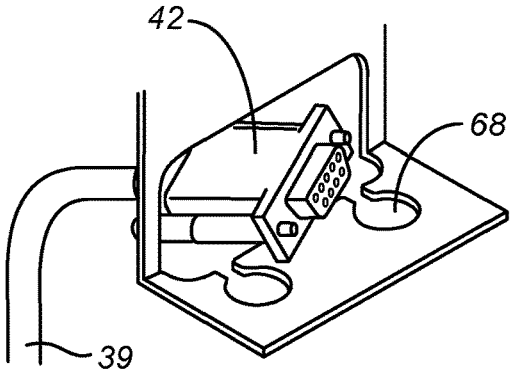
FIGS. 15 and 16 are simplified illustrations showing the placement of a video plug within the cable bay of a cable management device and securing the video plug cable within in a cable opening using an adapter sleeve to permit withdrawal of the video plug as suggested in FIG. 1.
Figure 16:
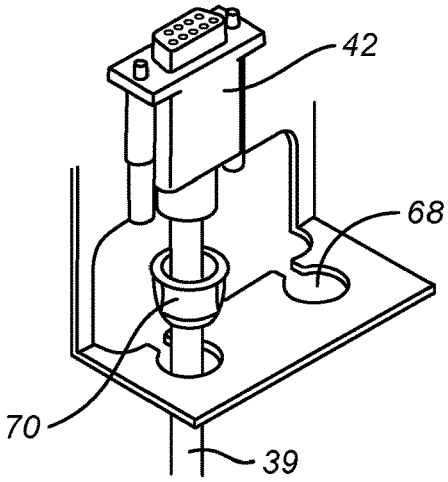

Utility power cord 16 can be plugged into a utility power socket 18 of utility power source 12. Various cables 39 can be connected to processor 14 and cable plugs 38 at the ends of cables 39 can be passed through cable window or opening 60 in lower portion 24 of housing 22, see FIGS. 4, 5, 9, and 10, and through cable window or opening 62 in cable management device 32. Cable management device 32 defines a cable bay 66 and is located within the non-power side 54 of lower portion 24 of housing 22. Cable management device 32 has a number of cable openings 68, two in the illustrated examples. FIGS. 15 and 16 are simplified views illustrating placing a video plug 42 within the cable bay 66 of a cable management device 32 and securing the video plug cable 39 within in a cable opening 68 using an adapter sleeve 70. This permits the video plug 42 to be pulled from the cable bay as suggested in FIG. 1. This also allows for various cables, including video, data or control cables, to pass through opening 55 in support member 59 in a first direction and be directed in a desired manner, such as in a second direction, transverse to the first direction, over and generally parallel to support surface 58.

Figure 19:
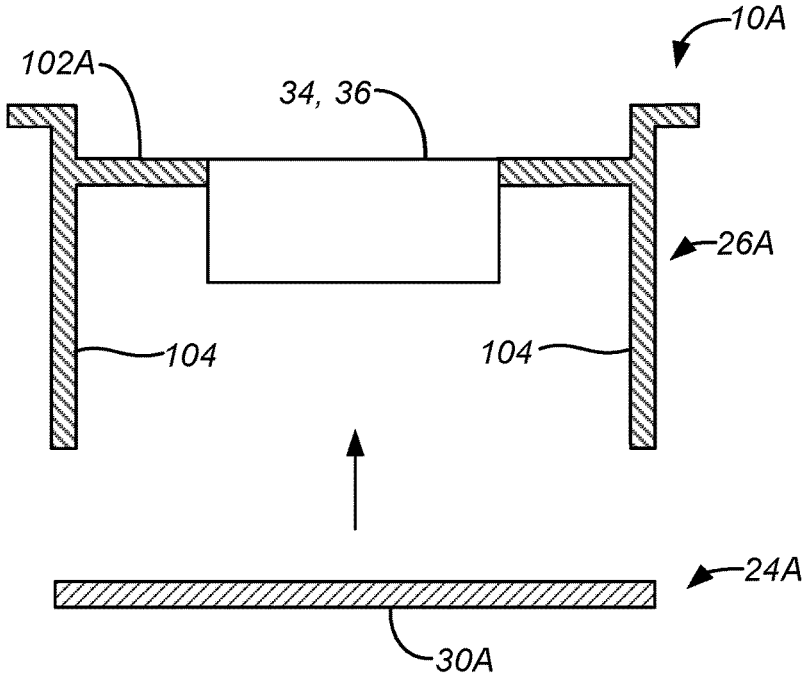
FIGS. 19 and 20 are schematic representations of two additional examples of interface modules with modifications to the lower and upper portions.

Other constructions for lower and upper portions 24, 26 of housing 22 are possible. FIG. 19 is a simplified view illustrating an example of an interface module 10A. The upper portion 26A of interface module 10A includes an upper element 102A and spaced-apart sidewalls 104 extending from the upper element. The lower portion 24A of interface module 10A includes a bottom element 30A secured to the side walls when the lower portion is in the second orientation.

Figure 20:
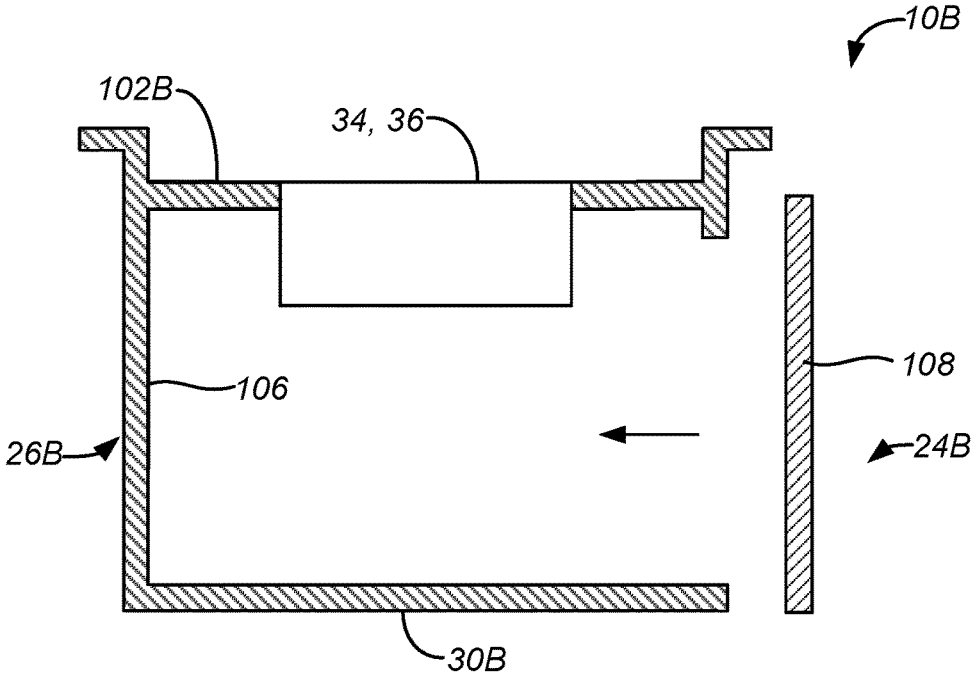

FIG. 20 is a simplified view illustrating another example of an interface module 10B. The upper portion 26B of interface module 10B includes an upper element 102B, a first side wall 106 extending from the upper element, and a bottom element 30B extending from the first side wall. The lower portion 24B of interface module 10B includes a second side wall 108 extending between the upper element and the bottom element.

Figure 21:
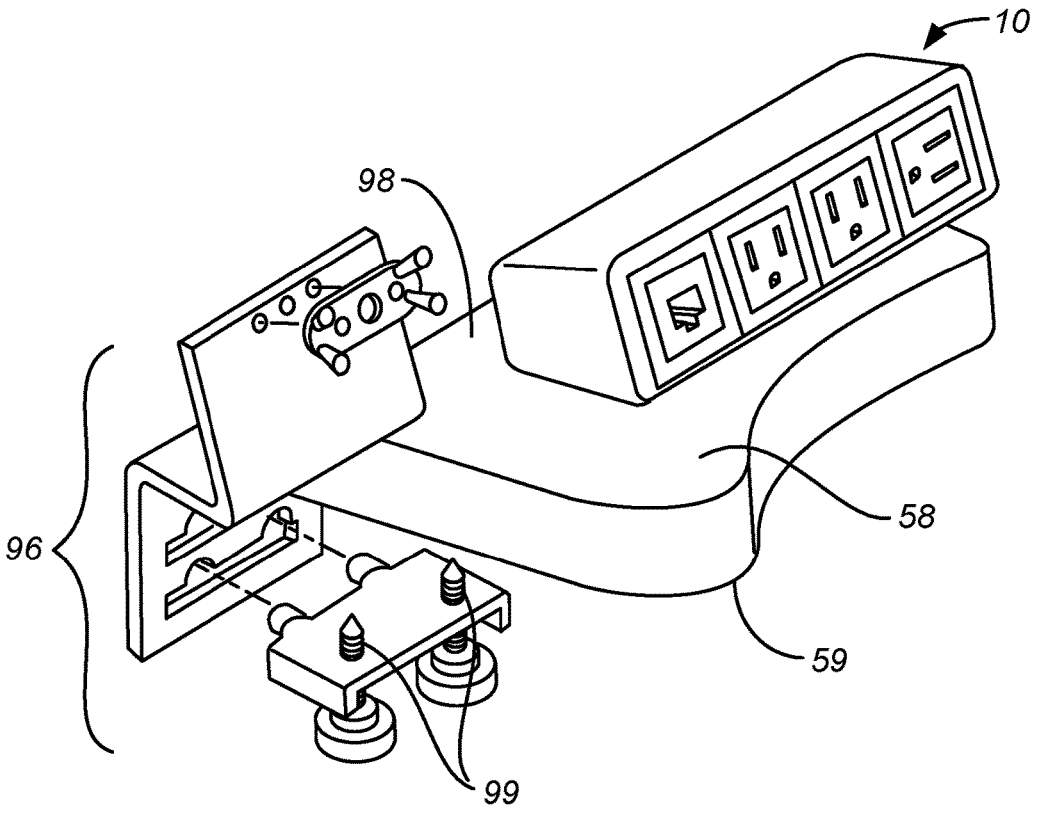
FIGS. 21 and 22 are simplified illustrations of an adjustable position mounting structure for mounting an interface module along an edge and above the upper surface of a support member.
Figure 22:
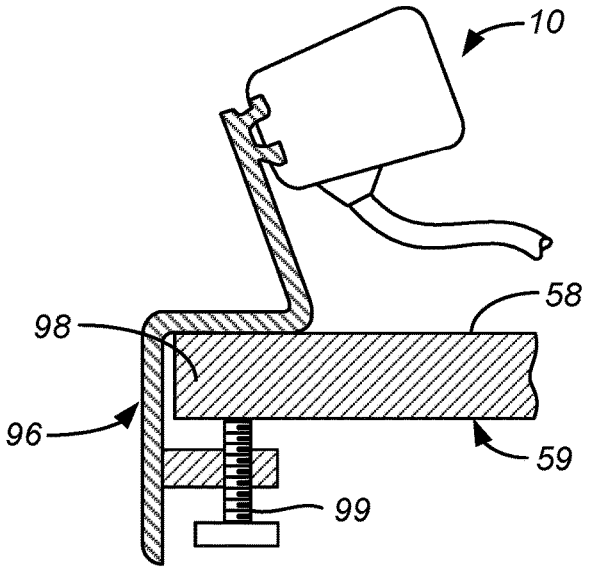
Figure 23:
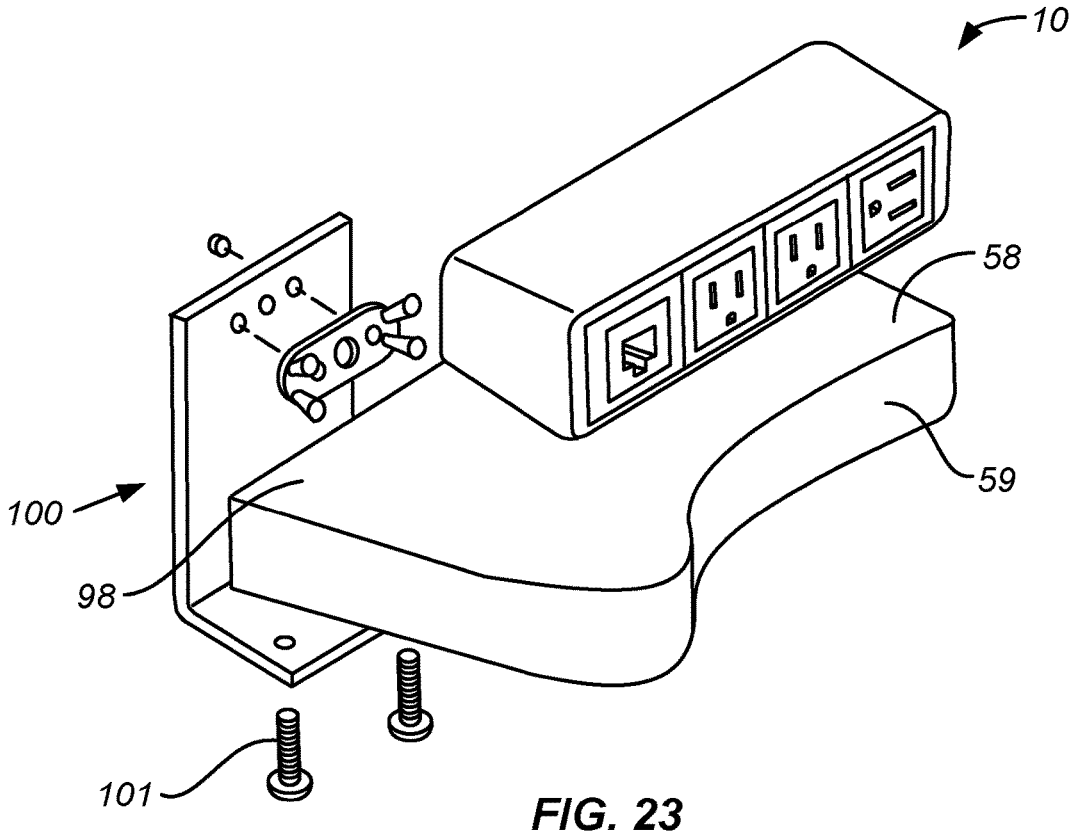
FIGS. 23 and 24 are simplified illustrations of a fixed position mounting structure for mounting an interface module along an edge and above the upper surface of a support member.
Figure 24:
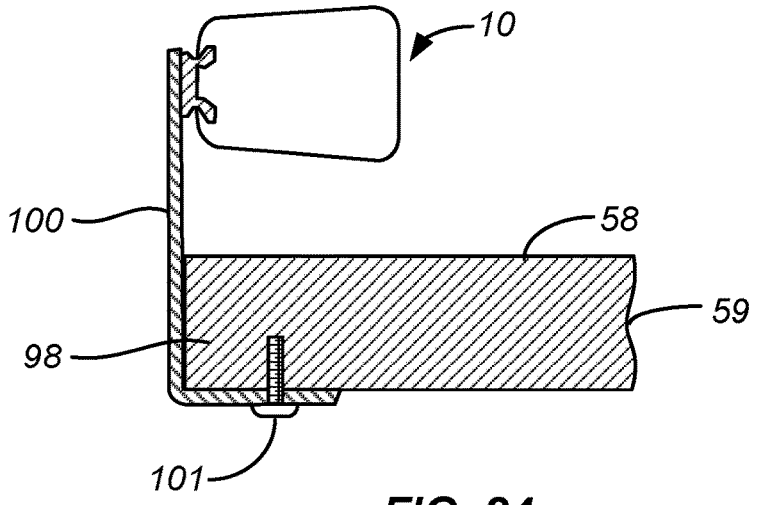

Interface module 10 can be mounted to support member 59 in ways other than within an opening in the support member, such as opening 55. FIGS. 21 and 22 are simplified illustrations of housing/support member securement structure in the form of an adjustable position mounting structure 96 by which interface module 10 can be mounted along an edge 98 of support member 59 to be located above support surface 58 using a pair of thumbscrews 99. FIGS. 23 and 24 are simplified illustrations of a housing/support member securement structure in the form of a fixed position mounting structure 100 by which interface module 10 can be mounted to support member 59 using screws 101. In this example interface module 10 is positioned along edge 98 and above support surface 58. In other examples housing/support member securement structure could be used to mount interface module 10 to a support member but not along an edge. While support surface 58 is illustrated as an upwardly facing, horizontal support surface, it could be at other orientations, including vertical or facing downwardly. In other examples housing/support member securement structure could be used to mount interface module 10 to a support member while not being secured to the support member, such as using a weighted base.

The lower portion 24 could be designed also to eliminate one or both of the end panels 72, 73 to reduce component count of the assembly which may save costs. Lower and upper portions 24, 26 of housing 22 can be made as extrusions; the extrusions could be made using a number of difference materials, such as aluminum or plastic. Extruded components could also be made using other manufacturing techniques producing, for example, a molded plastic component or a die cast metal component.

While implementations of the technology are disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the technology disclosed and the scope of the following claims. For example, in some examples interface module 10 is supported by but not attached to support member 59.

The above descriptions may have used terms such as above, below, top, bottom, over, under, et cetera. These terms may be used in the description and claims to aid understanding what is being disclosed and not used in a limiting sense.

One or more elements of one or more claims can be combined with elements of other claims.

Any and all patents, patent applications and printed publications referred to above are incorporated by reference.

What is claimed is:

1. An interface module supportable by a support member, comprising:

a housing comprising an upper portion, defining an access opening adapted to mount one or more interface assemblies, and a lower portion;

a utility power interface assembly mounted to the upper portion at the access opening, the utility power interface assembly having a utility power plug receptacle accessible from outside the housing, and further having an electrical connection element for receiving utility power for the utility power plug receptacle;

the lower portion placeable in a first orientation spaced-apart from the upper portion to provide substantially unhindered access to the electrical connection element, and in a second orientation secured to the upper portion, wherein while the lower portion is in the first orientation the electrical connection element is exposed for electrical connection only from inside a space which is enclosed when the lower portion is in the second orientation.

2. The interface module according to claim 1, further comprising a second utility power interface assembly mounted to the upper portion at the access opening, the second utility power interface assembly having a second utility power plug receptacle accessible from outside the housing and further having a second electrical connection element for receiving utility power for the second utility power plug receptacle, wherein while the lower portion is in the first orientation the second electrical connection element is exposed for electrical connection only from inside the space which is enclosed when the lower portion is in the second orientation.

3. The interface module according to claim 1, further comprising a second interface assembly mounted to the upper portion at the access opening, the second interface assembly comprising a USB device.

4. The interface module according to claim 1, wherein the access opening is adapted to mount the interface assemblies in rows overlying the space which is enclosed when the lower portion is in the second orientation.

5. The interface module according to claim 1, wherein the interface assemblies include a chosen one of an audiovisual interface device, a data interface device, and a communication interface device.

6. The interface module according to claim 1, wherein the lower portion has a bottom, the bottom secured to the upper portion when in the second orientation.

7. The interface module according to claim 1, wherein:

the upper portion comprises an upper element and spaced-apart sidewalls extending from the upper element, and the lower portion comprises a bottom element secured to the sidewalls when the lower portion is in the second orientation, and wherein the space from inside of which the electrical connection element is exposed for electrical connection while the lower portion is in the first orientation, includes an entire space that is bounded by the upper element, the spaced-apart sidewalls, and the lower portion when the lower portion is in the second orientation.

8. The interface module according to claim 1, wherein:

the upper portion comprises an upper element, a first side wall extending from the upper element, and a bottom element extending from the first side wall; and the lower portion comprises a second side wall extending between the upper element and the bottom element of the upper portion.

9. The interface module according to claim 1, further comprising a second interface assembly mounted to the upper portion at the access opening, the second interface assembly comprising a reduced power electrical interface device.

10. The interface module according to claim 9, wherein the reduced power electrical interface device comprises a DC device power receptacle accessible from outside the housing.

11. The interface module according to claim 1, wherein when the lower portion is in the second orientation the housing defines a housing interior which is partitioned by an isolation structure into a power side containing the space which is enclosed when the lower portion is in the second orientation, and a non-power side, the power side having an opening for one or more cables to pass into the power side from outside the housing without passing through the non-power side and the non-power side having an opening for one or more cables to pass into the non-power side from outside the housing without passing through the power side.

12. The interface module according to claim 11, wherein:

the non-power side further comprising a cable management device providing cable bays for positioning the cables through the access opening.

* * * * *